United States Patent [19]

Godberson et al.

[11] 4,073,592

[45] Feb. 14, 1978

[54] METHOD OF PAVING

[76] Inventors: Harold W. Godberson; Gary L. Godberson, both of Ida Grove, Iowa 51445

[21] Appl. No.: 650,467

[22] Filed: Jan. 19, 1976

[51] Int. Cl.[2] ..... E01C 23/02

[52] U.S. Cl. ..... 404/89; 404/105

[58] Field of Search ..... 404/108, 105, 106, 101, 404/82, 83, 84, 102

[56] References Cited

U.S. PATENT DOCUMENTS

| | | | |
|---|---|---|---|
| 940,061 | 11/1909 | Ransome | 404/96 X |
| 2,035,627 | 3/1936 | West | 404/106 |
| 2,044,883 | 6/1936 | Jackson | 404/102 |
| 2,068,702 | 1/1937 | Poulson | 404/82 |
| 2,072,479 | 3/1937 | Hadley | 404/102 |
| 2,251,095 | 7/1941 | Wood | 404/102 |
| 2,255,346 | 9/1941 | Baily | 404/102 |
| 2,289,168 | 7/1942 | Barber | 404/102 |
| 2,332,688 | 10/1943 | Baily | 404/102 |
| 2,396,426 | 3/1946 | Jackson | 404/102 |
| 3,015,258 | 1/1962 | Apel | 404/106 |
| 3,043,201 | 7/1962 | Maxon | 404/106 |
| 3,135,178 | 6/1964 | Guntert | 404/108 |
| 3,354,801 | 11/1967 | Hanson | 404/108 X |
| 3,533,337 | 10/1970 | Swisher | 404/102 |

*Primary Examiner*—Nile C. Byers
*Attorney, Agent, or Firm*—Henderson, Strom & Sturm

[57] ABSTRACT

A machine for concurrently laying a dual-layered cementitious composition on a base surface with the layers having different compositions. A self-propelled main frame has an adjustable platform frame overlying the main frame. Adjustable support elements are coupled to the main frame for changing the position of the main frame to conform with the grade characteristics of the base surface. A first receiving unit is coupled to and is extended in front of the main frame and receives the first cementitious composition. The first receiving unit includes a first strike-off element extending transversely to the normal direction of movement of the machine and is spaced a predetermined distance above the base surface. Upon movement of the machine forwardly, a bottom layer of the first composition is formed and shaped. A second receiving unit is coupled to and is extended between the main frame and the first receiving unit for receiving the second cementitious composition. The second receiving unit also contains a second strike-off element which extends transversely to the normal direction of movement of the machine and is spaced a predetermined distance above the first strike-off means. Upon movement of the machine forwardly, an upper layer of the second composition is formed on top of the first layer. A longitudinally extending slip-form is suspended from the main frame rearwardly of the first and second receiving units. As the machine moves forward the slip form passes over the top of the second cementitious composition thereby finishing its top surface.

3 Claims, 16 Drawing Figures

METHOD OF PAVING

BACKGROUND OF THE INVENTION

The present invention relates generally to highway paving equipment, and more specifically to equipment for laying a plurality of layers of material concurrently, in the same operation.

DISCUSSION OF THE PRIOR ART

It is well known and understood how to use large scale paving equipment for laying and finishing concrete in strips, particularly in the construction of parking lots, highways and other similar concrete structures. Furthermore, machines which utilize a method of slip forming for the shaping and finishing of concrete are presently in use and are enjoying wide spread acceptance in the paving industry. With the use of these automated concrete paving-finishing machines, the overall cost, time and labor involved in the paving of concrete has been significantly reduced.

Until recently, the concrete of a road-bed has had a thickness of several inches and by State or Federal law was required to consist entirely of certain types of material providing the required surface qualities of skid and wear resistance. Thus, the construction of highways necessitated the use of large quantities of expensive, high quality concrete throughout the total thickness of the pavement slab. This fact was further stressed in the past decade with the rapid expansion of the use of concrete in road beds and other construction projects, thereby causing the local availability of raw materials for forming the concrete composition to be greatly diminished. Some localities do not even have naturally occurring materials of the type required. This is particularly true of the special rocks or aggregates having the skid and wear resistance qualities that form a principal ingredient of the special concrete.

Recently, a new type of concrete called "Econcrete" has been undergoing research and development. This type of concrete is used as a first and lower layer and uses locally available aggregates, which would not necessarily be considered to be acceptable for the top surface of the concrete pavement. A top layer of concrete, however, is formed from the more costly materials necessary for providing a surface with the required skid and wear resistance qualities would then be placed on top of the bottom layer. This results in a concrete slab for forming a section of highway having an overall thickness of approximately 8 inches; for example, being comprised of a lower 6-inch slab which is constructed of inexpensive materials and a 2-inch slab placed directly on top of it containing the necessary wear and skid resistant materials which are much more costly. Therefore, a substantial savings is possible in the construction costs of most highways, since it would be possible to use locally available natural materials for a major portion of the concrete work.

However, the savings realized because of the reduced material cost might be offset by the expense and time involved in laying two separate layers. This is true because the most obvious method of laying such a pavement would be to first apply a bottom layer, letting that layer cure, and then to apply a top layer containing the necessary skid and wear resistant materials.

Therefore, there is a definite need for a machine for concurrently applying the two layers of concrete for the purpose of taking advantage of the reduced cost of raw materials of the lower layer, but without the disadvantages of the extra time and expense involved when two layers of concrete are formed by the above mentioned process.

SUMMARY OF THE INVENTION

The present invention relates to a machine for simultaneously shaping a plurality of compositions in layers particularly for the purpose of forming pavement having at least one lower layer of material of an inexpensive variety and a top layer of material having all of the properties of wear and skid resistance needed for highways and the like. The machine has a frame having a unit on the front portion thereof for receiving a first composition. A strike off mechanism is also attached to the frame within the first receiving unit for the purpose of leveling the first composition. A second receiving unit is also attached to the frame behind the first receiving unit for receiving a second composition and depositing this second composition on top of the first composition after the first composition has been leveled. A second strike off mechanism is disposed within the second receiving unit and at the rear thereof for leveling the top of the second composition. A pair of parallel side forms are transversely spaced and are longitudinally depending from the first and second receiving units for regulating the width of the pavement being formed.

An object of the present invention is to provide a machine capable of laying concurrently, in the same operation, two or more layers of a cementitious composition with the layers being composed of different compositions.

Another object of the present invention is to provide a machine which is capable of laying slabs of variable widths.

A further object of the present invention is to provide a machine for concurrently laying a dual-layered comentitious composition wherein the overall depth of the concrete slab and the individual thickness of each layer may be controlled and easily changed.

Still another object of the present invention is to provide a machine for concurrently laying a cementitions composition on a base surface with a machine requiring only minimal clearance for paving next to obstacles and adjacent to pre-existing concrete slabs.

A still further object of the present invention is to provide a machine for currently laying a dual-layered cementitious composition on a base surface which is easy to load and transport to the paving site.

Other objects, advantages and novel features of the present invention will become apparent from the following detailed description of the invention when considered in conjunction with the accompanying drawings.

DESCRIPTION OF THE PREFERRED EMBODIMENT

Figure 1:
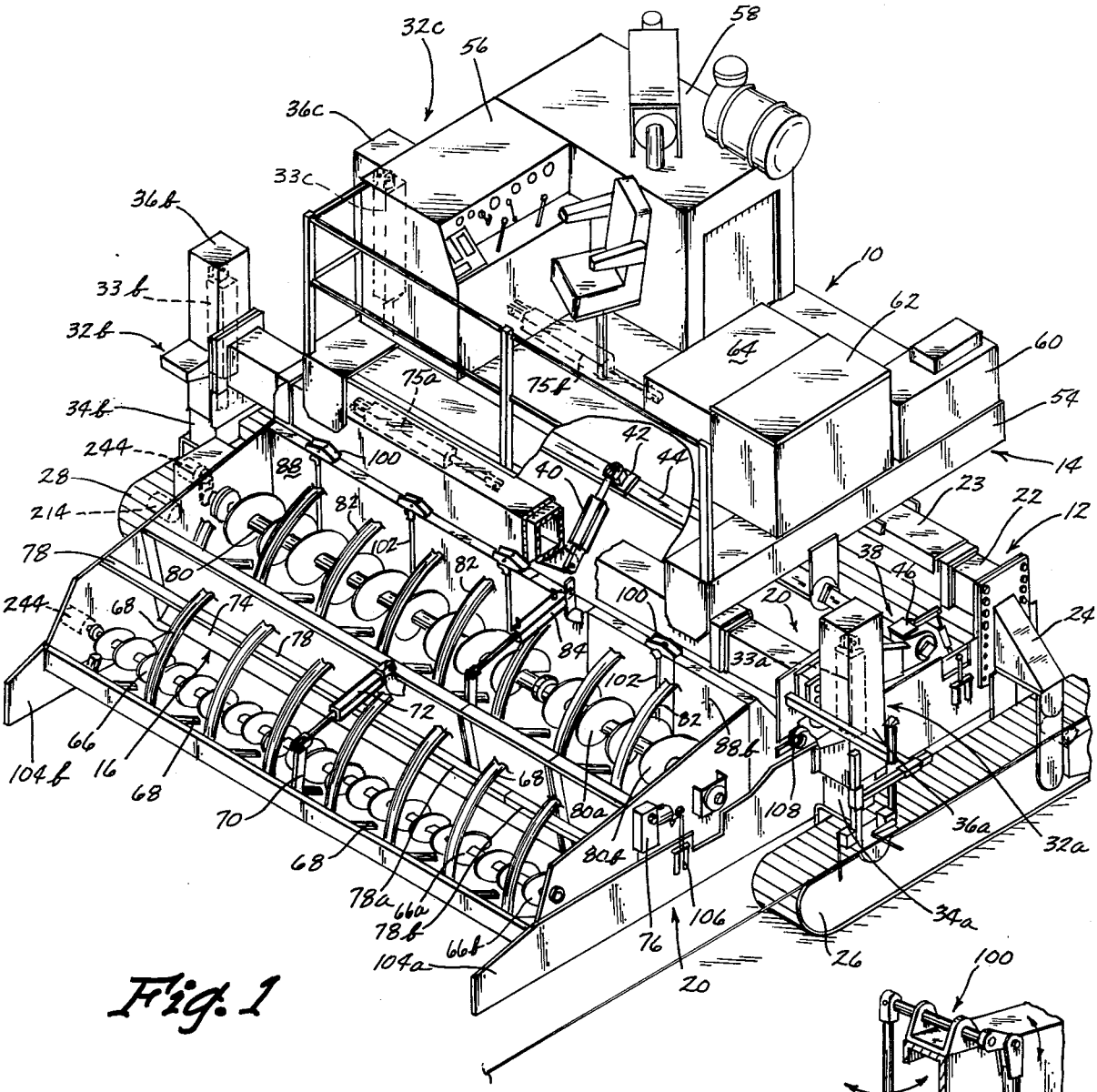
FIG. 1 is a perspective view of a dual-layered pavement laying machine according to the present invention.

Referring now to the drawings wherein like reference numerals designate identical or corresponding parts throughout the several views, FIG. 1 shows a dual coarse concrete laying machine including a self-propelled telescoping main frame 12 and a platform frame 14 overlying the main frame 12. A first receiving unit 16 is secured to and extends in front of the main frame 12 for receiving a first composition to be used to form the first and lowermost layer of the pavement. A second receiving unit 18 is coupled to the frame and is disposed behind the first receiving unit 16 for receiving a second composition which is to form the top of the pavement. A longitudinally extending slip-form 20 is also secured to the frame and extends rearwardly of the second receiving unit for providing a desired finish to the top layer of the concrete being laid.

The main frame 12 (FIG. 1) includes a transversely telescoping rear bolster 22 upon which is positioned a transverse mounting member 23. One side of the rear boster 22 is connected to a yoke assembly 24, which, in turn, is pivotally connected to an endless track unit 26. The other end of the rear bolster 22 is connected to a vertical post device 32*c* and the vertical post device 32*c* is pivotally attached at its lower end to a track unit 28. The endless track units 26 and 28 are of a conventional type and are used for the purpose of propelling the machine 10 in the direction desired.

A front telescoping member 30 extends transversely across the machine and behind the second receiving unit 18. This front telescoping member is disposed in a parallel relationship with respect to the rear bolster 22 as is clearly shown in FIG. 1. The ends of the front member 30 are rigidly attached to the vertical post devices 32*a* and 32*b*. The bottom of the device 32*a* is pivotally connected to a front portion of the track unit 26 and the bottom end of the device 32*b* is pivotally attached to a portion of the endless track unit 28.

Each of the adjustable post devices 32*a*, 32*b* and 32*c* are virtually identical in structure and include a hydraulic cylinder therein which is selectively functional to shorten or lengthen the effective length of each respective member 32*a*, 32*b* and 32*c*. An outer housing is formed around each of the hydraulic cylinders within each of the adjustable post devices 32*a*, 32*b* and 32*c*, and each of these adjustable devices has an outer housing consisting primarily of lower telescoping members 34*a*, 34*b* and 34*c* which are telescopically received in upper telescoping members 36*a*, 36*b* and 36*c* respectively. The telescoping nature of the exterior of these posts is not, however, critical to the operation of the present invention, since double-acting cylinders 33*a*, 33*b* and 33*c* form the important part of these adjustable post devices 32*a*, 32*b* and 32*c*. The adjustable post devices 32*a* and 32*b* operate essentially as disclosed in U.S. Pat. No. 3,779,661 to Godbersen. For example, the cylinder 32*b* can be used as the grade cylinder to automatically control the position of the front end of the machine with relation to the grade characteristics as desired either manually or automatically. The slope cylinder device 32*a* functions as described in the above mentioned patent to cause the level of that side of the machine to be at a predetermined level above, below or even with the other side of the machine being controlled by the grade device 32*b*. When the device 32*b* for controlling the grade adjusts upwardly or downwardly, the device 32*a* will move accordingly to keep the slope in a desired relationship with respect to the other side of the machine. It will also be clear that it is not critical as to which side is used as a grade control and which side is used as a slope control. This operation will be clearly understood by reference to the above mentioned patent.

A third adjustable post device 32*c* is provided on one side of the machine and rearwardly of the adjustable post device 32*b*. The construction of this adjustable post device 32*c* is identical to that of 32*a* and 32*b* but there is no automatic control associated with this cylinder 32*c*. The purpose of the rear post device 33*c* is provided primarily for facilitating the use of this machine to lay one strip of concrete next to a strip of concrete which has already been laid. The problem with previous machines not having this cylinder was that when one of the track units 26 or 28 was driven up on to a pre-existing strip or slab of concrete that the machine could not be leveled properly without extensive unbolting and rebolting of one of the rear yoke units, for example of the type as shown by the yoke unit 24 in FIG. 1. With this new arrangement using a rear adjustable post device 32*c*, one of the track units, for example the track unit 28, can be driven up on a pre-existing slab, the adjustable post device 32*b* and the adjustable post device 32*c* can then be used to raise the track unit 28 with respect to the frame 12 so that the machine itself will not perceive the difference between the situation where the track 28 is running on the ground and the adjusted position wherein the track unit 28 is running on an elevated slab of concrete which was previously formed. Accordingly, then the top of the slab being formed will ideally be at the same level at the point where the previously formed slab and the slab being formed meet.

Figure 6:
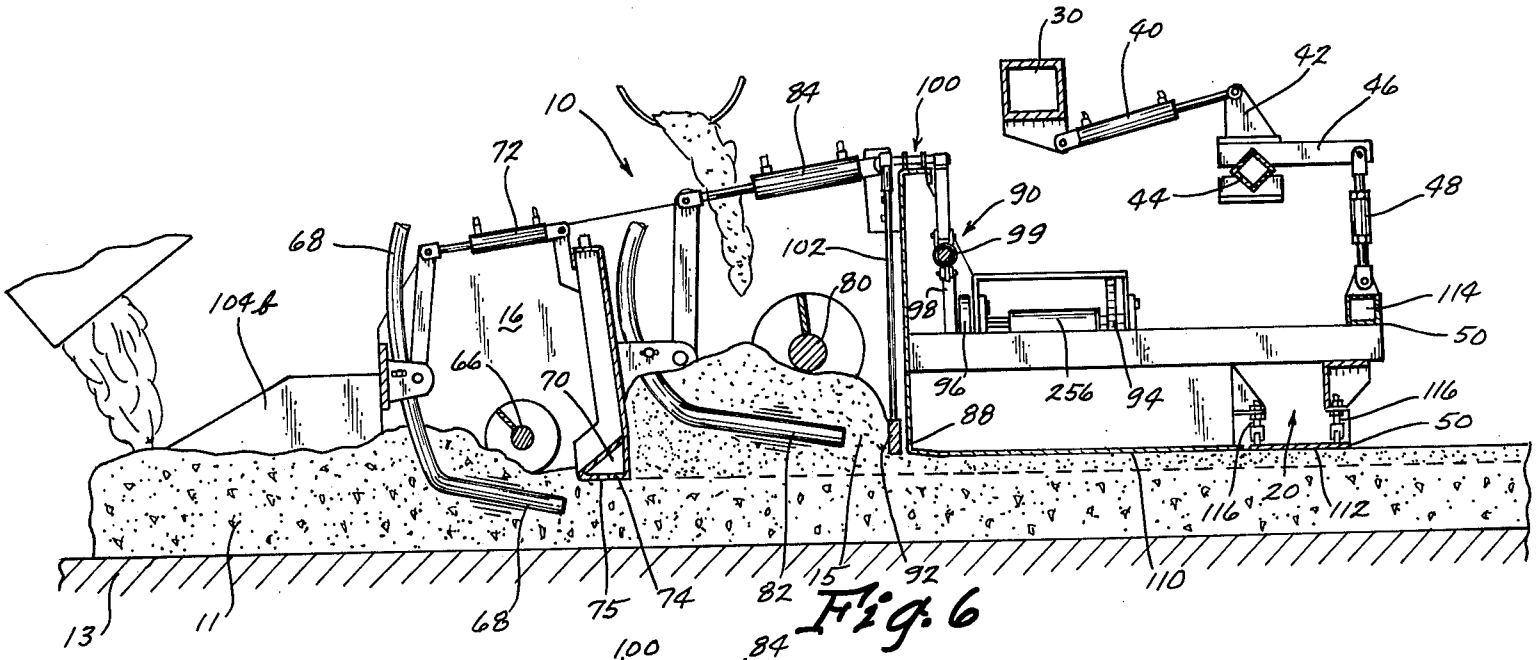
FIG. 6 is a side cross sectional view taken along line 6—6 of FIG. 4 and showing the present invention in operation.
Figure 7:
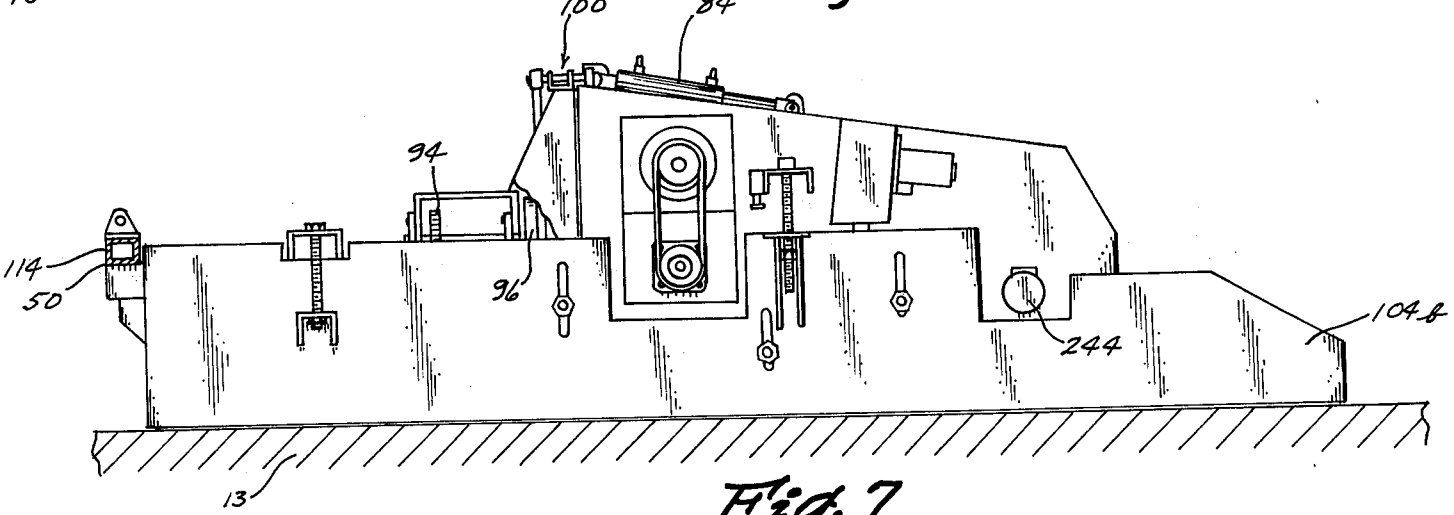
FIG. 7 is a side view taken along line 7—7 of FIG. 4.

The main frame 12 further includes a slip form hold down structure 38 (FIGS. 1, 6 and 7). The slip form hold down structure 38 includes a hold-down cylinder 40 which at one end is pivotally connected to a front telescoping member 30. The other end of the hold-down cylinder 40 is pivotally connected to the cylinder mounting bracket which is, in turn, rigidly connected to a telescoping hold-down tube 44. Connected rigidly to the telescoping hold-down tube 44 is a hold-down bracket 46 to which is pivotally connected to the rear of a slip form 20 at point 50. By the expansion and contraction of the hold-down cylinder 40, the cylinder mounting bracket 42 moves about a horizontal axis which, in turn, produces a rotating of the telescoping hold-down tube 44. When the hold-down tube 44 rotates, the hold-down bracket exerts a vertical force against the hold-down turn buckle 48, which force is directly transmitted to the slip form 20 at point 50. This causes the slip form to exert a predetermined pressure on the surface of the second cementitious composition to properly finish the surface thereof.

The platform frame 14 includes a front member 52 and side members 54. The front member 52 rests upon the front telescoping member 30 to provide the necessary support to the front of the platform frame 14. The rear of the platform frame 14 is supported by a transverse mounting member 23 which is positioned on the rear bolster 22.

The platform frame 14 forms a mounting surface upon which the necessary controls for the operation and control of the machine are located, for example on a control panel 56. Further, an internal combustion engine which provides the power to the hydraulic pumps is mounted at the rear of the platform frame 14 in the engine compartment 58. The hydraulic pumps (not shown) are also mounted in the engine compartment 58. Also located on the platform frame 14 is a hydraulic oil reservoir 60, a fuel tank 62 and an auxiliary console box 64 which contains a partial array of hydraulic control circuits, with the remainder of the control circuits being located in the control panel 56.

The first receiving unit 16 further includes an auger 66 (FIGS. 1, 4, 6 and 8), which is transversely extended across the front of the unit 16. During normal operations, the auger 66 will spread the first cementitious composition out within the first receiving unit 16 so as to completely cover the area of the base surface that is enclosed within the receiving unit 16. The augers 66 and 80 are hydraulically operated and their speed may be accordingly controlled by the operator. Also positioned in the first hopper 16 are vibrators 68 (FIGS. 1, 4, 5, 6 and 8). The vibrators 68 are hydraulically powered and the degree of vibration may also be controlled by the operator. The vibrators 68 are disposed in a uniformly spaced fashion across the receiving unit 16 and extend into the first cementitious composition to produce an oscillatory vibration in the first cementitious material to remove air pockets within the material and make the composition more dense. The vibrators 68 are spring mounted on a hydraulically controlled hold-down frame 70 and the frame 70 is pivotally mounted to the front of the first receiving unit and is controlled by the operator through the hydraulic cylinder 72.

The first receiving unit 16 further includes a first strike-off element 74 (FIGS. 1 and 4) which is positioned transversely to the direction of movement of the machine at the rear of the hopper 16. The first strike-off element 74 is positioned a predetermined distance above the base surface upon which the first cementitious composition is placed. This predetermined distance is hydraulically controlled by element 76.

An optional feature of the present invention would be to provide apparatus associated with strike-off means 74 for applying a debonding agent to the top of the first composition just before the second composition is laid on top of it, for example such as introducing such debonding agent into a chamber 70 (FIG. 6) and allowing it to pass through openings 75. Such debonding agent could also be applied by spraying or by many other means. The purpose of such a modification would be to allow relative movement between the first and second compositions when these two compositions are formed of materials with a significantly different coefficient of expansion and contraction so as to prevent cracking of the pavement during extreme temperature changes. When the coefficient of expansion and contraction of the two different compositions are approximately the same, it would probably not be necessary, and maybe not desirable, to use a debonding agent, but rather to allow the two layers to bond together to form one solid piece of pavement.

Upon operation of the machine 10 in a forwardly direction, the first strike-off element 74 will strike off the first composition and thereby control the depth of the bottom layer of the first cementitious composition consequently determining the top level of the first cementitious composition. A support beam 78 also extends across the front of the first receiving unit 16 for providing additional support to the unit 16.

Figure 8:
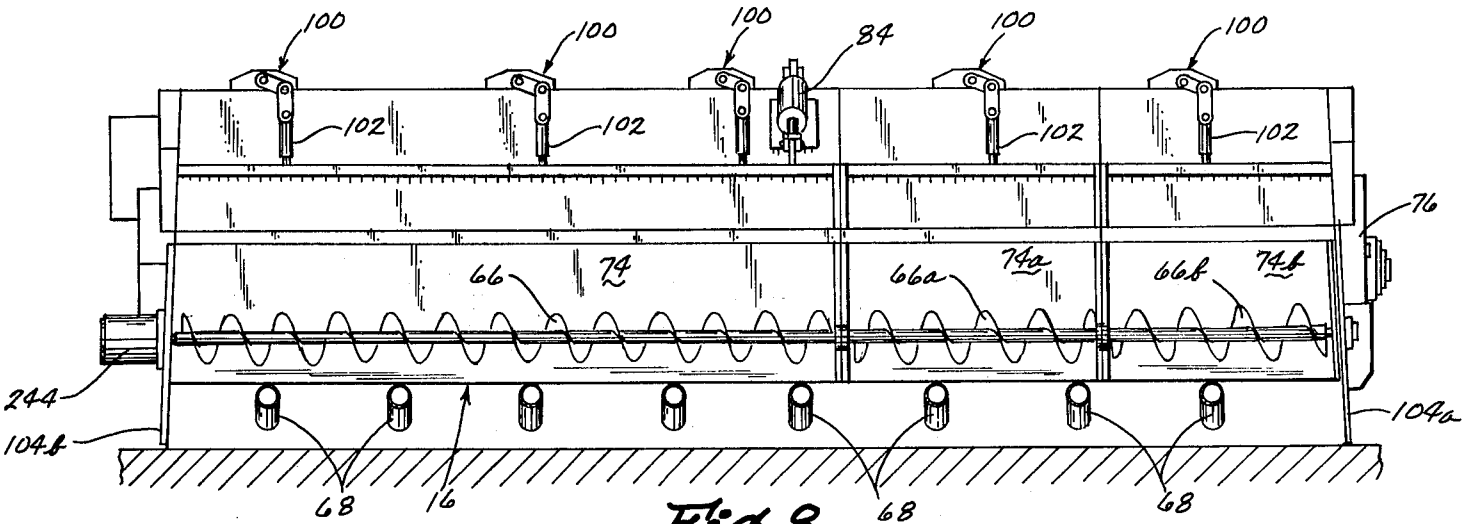
FIG. 8 is a front view of the first and second receiving units taken along line 8—8 of FIG. 4.

In instances when it is desirable to form a single slab of concrete having a greater width than that typically used, extensions may be added to the machine to allow the machine to pour such a wider slab. As shown in FIG. 8, the augers 66 include extensions **66*a* and 66*b*. Additionally, the support beam 78 includes extensions 78*a* and 78*b* (FIG. 1), and the first strike-off element 74 excludes extensions 74*a* and 74*b* (FIG. 8) respectively. In order to accommodate the wider profile of the first receiving unit 16 and the second receiving unit 18, to be described later, the rear bolster 22 and the front telescoping member 30 are telescoped outwardly hydraulically to the appropriate width. Hydraulic cylinders 75*a* and 75*b* (FIG. 1) are attached to the rearward side of both the rear bolster 22 and the front telescoping member 30, with one end secured to the outer beam and the other end secured to the inner telescoping beam, such that when each cylinder expands or contracts, the inner beam telescopes into or out of the outer beam. Additionally, the telescoping hold-down tube 44** also telescopes in a similar manner without the use of a separate hydraulic cylinder.

Figure 4:
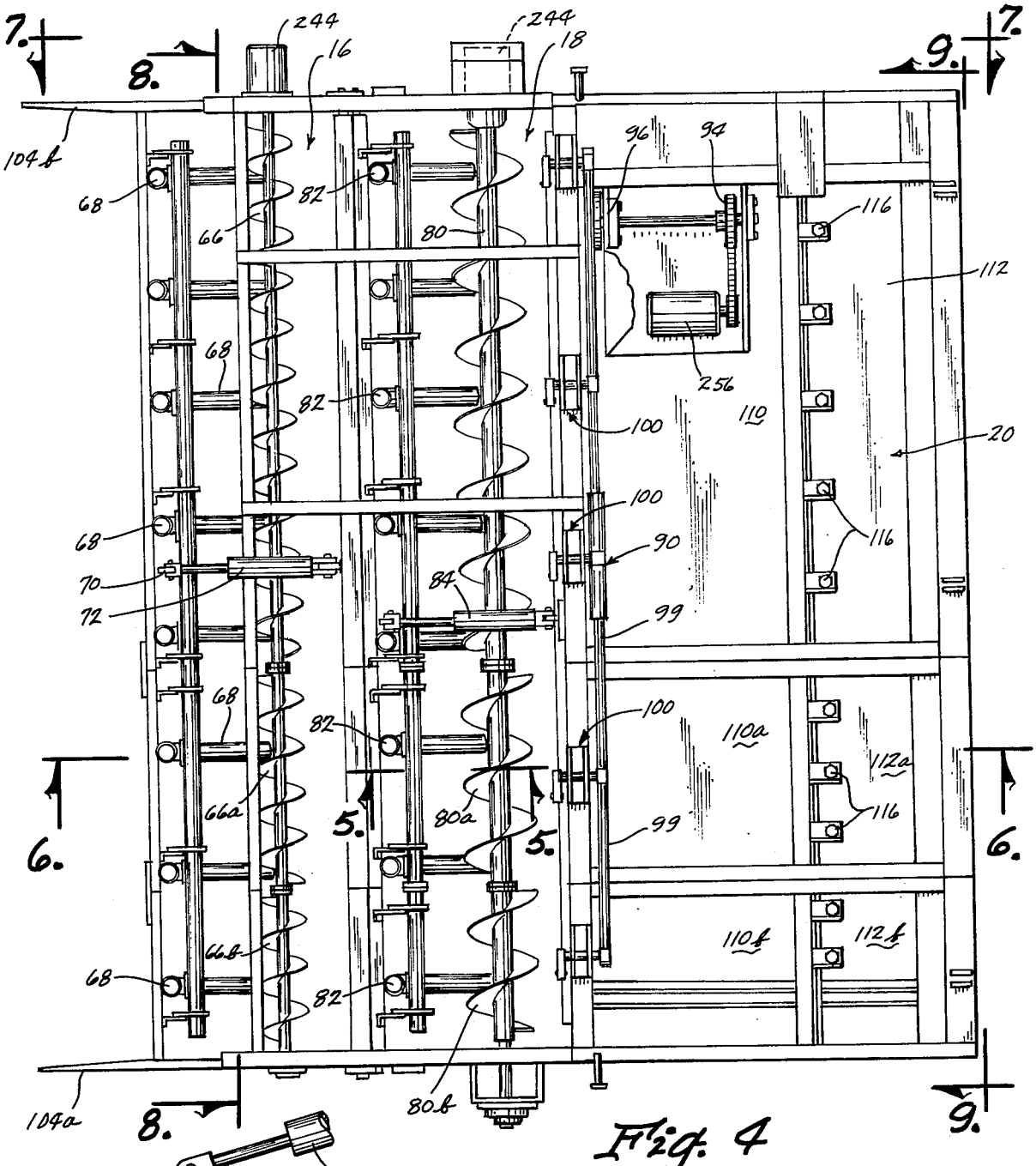
FIG. 4 is a top view of a first and a second receiving units and the slip form assembly.
Figure 5:
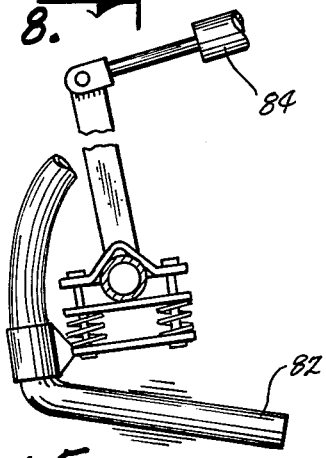
FIG. 5 is a view of a vibrator assembly taken along line 5—5 of FIG. 4.

Positioned directly behind the first receiving unit 16 is the second receiving unit 18 (FIGS. 1, 4 and 6). The second receiving unit 18 includes an auger 80 transversely extended across the unit 18 with its function being similar to the auger 66 of the first unit 16. The second auger 80 is, however, positioned a distance above the height of the first strike-off element 74 to prevent its interference with the formed bottom layer of the first cementitious composition. Additionally, positioned within the second unit 18 are vibrators 82 (FIGS. 1, 4, 5 and 9) which are used in the same manner as the vibrators 68 used for the first receiving unit 16. The vibrators 82 are spring mounted on a hydraulic hold-down frame 84, which by actuation of the hydraulic cylinder 86 allows the operator to control the depth of the vibrators. Additionally, both the speed of the augers 66 and 80 and the intensity of the vibrators 68 and 82 may be individually controlled by the operator.

The second receiving unit 18 also includes a second strike-off element 88 (FIGS. 1, 4, and 9) which extends transversely to the direction of movement of the machine and is spaced a predetermined distance above the first strike-off element 74. The purpose of the second strike-off element 88 is similar to that of the first strike-off element 74, that purpose being to control the depth of the second and top layer of the cementitious composition upon passage of the machine in a forwardly direction. As discussed above in reference to the widening of the first receiving unit 16, the second receiving unit 18 may be widened in a manner similar to that of the first hopper, with additional lengthening augers 80*a* and 80*b* being inserted along with additional strike-off elements 88*a* and 88*b*. Also, additional vibrators would naturally be placed within the second receiving unit 18 in such an arrangement.

The second receiving unit 18 also includes a tamping bar 90 (FIGS. 1, 3, 4, 9 and 9) which extends transversely to the direction of movement of the machine and is positioned in the rear of the second unit 18 directly in front of the second strike-off element 88. The tamping bar 90 has a reciprocating motion which smoothes the surface of the second cementitious composition before it passes under the second strike-off element 88. This reciprocating movement of the tamping bar 90 is created by a hydraulically operated motor 92, the speed of which is controlled by the operator. The motor 92 is coupled to a pitman drive assembly 94 which is connected to an eccentric pulley 96. A pitman arm is pivotally connected to the eccentric pulley 96 at one end and pivotally connected to a drive rod 99 at the other end for transmitting a horizontal reciprocating motion to the drive converters 100. The drive converters 100 are spaced on top of the second strike-off element 88 for the purpose of converting a horizontally reciprocating motion into a vertical reciprocating motion. This motion is, in turn, transferred by connecting rods 102 to the tamping bar 92.

Figure 2:
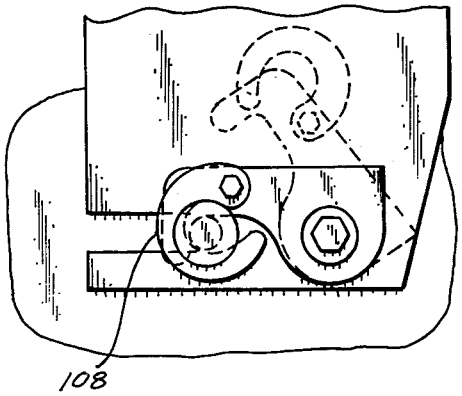
FIG. 2 is a partial side view of one of the locking assembly for locking the first and second receiving units together.
Figure 3:
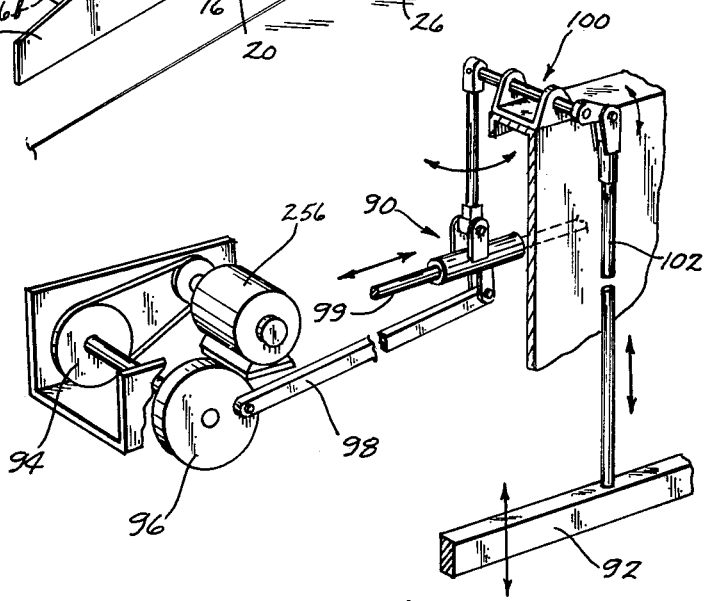
FIG. 3 is a partial perspective view of the tamping bar assembly.

The slip form 20 is positioned under the main frame 12 and extends longitudinally and rearwardly therefrom. The slip form 20 includes a pair of parallel, longitudinally extended, transversely spaced side forms 104*a* and 104*b*. The side forms 104*a* and 104*b* depend from the first and second receiving units 16 and 18 and determine the width of the top and bottom layers of the cementitious composition. The side forms 104*a* and 104*b* pass directly above and on each side of the base surface on which the cementitious composition is placed. An attachment latch 102 (FIGS. 1 and 2) is used to attach the mule or form and side plates 104*a* and 104*b*. The height of the side forms can be adjusted by manually adjusting screws 106 when the machine is not in operation. Any further adjustments to the side forms are done by the machine itself as it adjusts to grade and slope. The slip form 20 also includes a top portion 110 which extends rearwardly of the second hopper 18 and underneath the main frame 12. The top portion 110 provides the finishing to the top of the second layer of the second cementitious composition as the machine 10 moves forwardly. The top portion 110 may include extensions 110*a* and 110*b* (FIG. 4) for paving a concrete strip which is wider than normal. A rear slip form 112 (FIGS. 4 and 9) extends transversely across the machine directly behind the end of the top portion 110 of slip form 20. This rear slip form 112 is preferably constructed of a stainless steel surface which provides additional finishing to the top of the concrete surface and may contain extensions 112*a* and 112*b*.

Downward pressure on the slip form 20 is provided by the slip form hold-down structure 38 connected to the top portion 110 and to the rear slip form 112 by a transversely spaced rear member 114 extending across the top of the slip forms 110 and 112. The transversely spaced rear member 114 receives the downward force directly from the hold-down turn-buckles 48 and transmits this force directly to the two slip forms 110 and 112 to insure proper surface finishing.

At the rear of the top portion 112 of the slip form 20 and the slip form 112, adjusting screws 116 (FIG. 9) are attached for providing a fine vertical adjustment to the top portions 110 and 112 of the slip form 20. This allows very close adjustment of the slip form to meet close tolerances and to correct for any sagging or settling of the machine.

The machine 10, while initially being suited for working with typical cement compositions used in highway construction, the term cementitious is not intended to be limited merely to a portland cement mixture. Cementitious is intended to include aggregate mixtures including materials used to form a sub-base upon which a typical cement may be formed, such as a lime stabilized material, soil stabilized cement or even an asphalt composition. For example, the machine 10 may be adapted to lay a sub-base composed of one or more layers having different compositions and a finished surface on top of the sub-base having one or more layers also having different compositions in a simultaneous operation.

In some instances it may be desirable to attach a grade trimmer onto the front of the machine 10, such as one of the type disclosed in U.S. Pat. No. 3,779,661 to Godbersen which patent is hereby incorporated herein by reference.

As discussed above, the machine is controlled by hydraulic equipment powered by an internal combustion engine.

Figure 15:
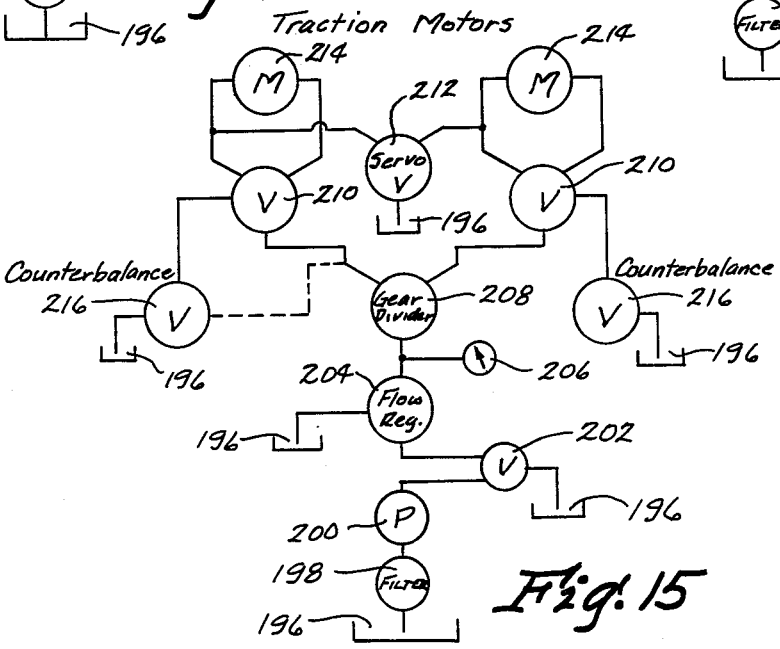
FIG. 15 is a diagram showing the hydraulic control system for the hydraulic motors that advance or drive the machine along the base surface.

Referring now to FIGS. 10–15 and in particular FIG. 15, the hydraulic oil for the traction circuits is supplied by the front stage of the righthand main pump 200, from the sump filter 198 and the reservoir 196. The hydraulic line passes through a power operated relief valve 202, which is correctly set to bypass at a predetermined pressure into the reservoir 196. The variable travel control valve 204 allows the operator to control the oil flow to increase or decrease the travel speed. When this valve 204 is fully opened in one direction, oil passes directly to the oil reservoir 196. From that position, as the valve is turned in an opposite direction, a portion of the oil is directed into the travel circuit. A tractive pressure gauge 206 monitors the hydraulic pressure of the system at the output port of the variable travel control valve 204.

The hydraulic oil then passes through the gear type flow divider 208, which divides the flow, routing it into two four-way control valves 210. The four-way tandem center control valves 210 are pressure compensated. In the neutral position, the oil at the inlet flows directly through the valve and to the oil reservoir 196. In the forward position, the oil is routed to the input port of the hydraulic track drive motor 214, which, in turn, drives the machine 10 forward. In the reverse position, the oil is directed to the outer input of the motor to drive the motor in reverse, thereby causing the machine 10 to move backwards. The hydraulic motors 214 are bi-directional and drive the tracks through a ratio gear box. A steering servo valve 212 is used to guide the machine automatically along a straight line or along an existing concrete edge surface. A counter-balance valve 216 assures an accurate automated steering by applying a constant back pressure to the track circuits oil return.

A hydraulic lift circuit is powered hydraulically from a pressure compensated pump 220 driven from the engine cam shaft. Oil is supplied from the reservoir 196 via this pump 220.

The hydraulic lift circuit is a constant pressure system, which merely means that when all of the valves 228 are in neutral position that the circuit pressure is substantially constant. This constant pressure is maintained by the pressure compensated piston pump 220 and the level is indicated by the pressure gauge 224. Oil is directed from the pump 220 to a solenoid valve 226. This valve 226 is a normally closed solenoid valve controlled by the lift circuit power switch located on the control panel. When the switch is in an off position, the solenoid is de-energized, thereby closing the valve and blocking the path to the servo valves 228. When the oil supply is blocked, the lift circuit is inoperative.

With the lift circuit power switch in an on position, the solenoid coil of the valves 226 are energized and the oil path is then caused to be opened supplying oil to the servo valves 228. The lift servo valves 228 control the oil supply to the right and lefthand cylinders **33*a* and 33*b***. These valves open and close when signaled by the automated control circuit located on the control panel.

The hydraulic hold-down circuit is a constant pressure system and may be powered by the same pump 220 that supplies oil to the lift circuit. Oil is routed from the pressure compensated pump 220 to the control valve 230. The hydraulic control valve 230 is a four-way valve with a closed center spool. In one position of the valve a constant pressure is supplied to the pressure reducing valve 232. The pressure reducing valve 232 controls the hold-down pressure by regulating the oil pressure and flow to the hold-down cylinder 86. If the uplift pressure of the concrete exceeds the operator set pressure, oil will be bypassed to the reservoir 196.

When the hydraulic control valve 230 is in another position, oil is routed direct to the end of the hold-down cylinder 86, causing the cylinder 86 to retract and force the oil and the piston end back through the pressure reducing valve 232 to the oil reservoir 196.

The lefthand pump 234 powers all five circuits, i.e. the first hopper vibrators circuits, the second hopper vibrator circuits, the rear lift circuits, the front frame extension and the rear frame extension circuits.

The five four-way control valves 231 are gang mounted and are connected in series with a common input and return line to the reservoir 196. Each of the valves 231 has a spring return biasing it to a neutral position and in such position it directs the oil flow to the reservoir 196. Each valve controls one cylinder, and when activated, the oil is routed to one end of the cylinder causing the cylinder to be either retracted or extended, with the oil at the opposite end of the cylinder forced back through to the oil reservoir 196.

The hydraulic circuit pump for the augers in the first unit 16 and the second unit 18, is powered by the rear stage of left main hydraulic pump 240. The two four-way control valves 242 are tandem center pessure compensating valves having a metering spool. In the off position, the oil is routed directly to the reservoir 196. In the right position, oil is routed to the input side of the hydraulic motor causing the auger to move the concrete to which ever side is desired because the auger motors 244 are both bi-directional.

The tamper bar circuit is driven by the right stage of the right main pump 200. The system pressure gauge 248 allows the operator to monitor the system pressure at the input of the control valve 250. The automated system shut-off is controlled by a DC control switch which activates the solenoid valve 252.

The operator controlled main on-off control valve 250 is a three-way control valve with an internal relief system set at a predetermined level above the pilot operated relief valve 246. In an off position, the hydraulic oil is diverted to the oil reservoir 196. In an open position, the hydraulic oil flow is diverted to the variable flow control valve 254 and the variable flow control valve 254 allows the operator to control the tamper bar speed. From the output of this variable flow valve, oil is routed to the input of the hydraulic driving motor 256, which then drives the tamper bar.

The hydraulic vibrator circuits are powered by the front stage lefthand main pump 240. The oil flows through the pressure relief valve 258 to protect the pump which is set to bypass oil at a predetermined pressure. The system pressure is monitored by a pressure indicator gauge 260. Control valve 262 is used as the systems manual on-off control. It is a standard three-way valve and in an off position the oil is diverted to the reservoir 196 and through the oil cooler 264. In an on position, oil is diverted directly to the vibrator circuit. A gear-type flow converter 266 splits the oil flow, diverting half of the oil to each of the left and right banks of the individual vibrator circuits. To protect the flow divider, the pressure relief valve 268 is located at each output port of the flow divider, set to bypass oil to the reservoir 196 upon reaching a predetermined pressure. From the gear-type flow divider 266, the oil flows through input ports of the four-way gear-type flow dividers 270, which divides the oil again to supply each vibrator. From the four-way flow dividers 270, the oil flows to the input ports of the variable flow valves 272, which allows the operator to regulate the flow to the vibrators individually. From the flow control valves 272, the oil flows to the vibrators 68 and 82 and the back through the return line to the coil cooler 264 and then into the reservoir 196. It should be noted in FIGS. 10 and **10*a* showing the schematic diagram of the hydraulic circuit for the vibrators, that the components above the pressure gauge 260 are identical for both of the vibrators 68 located in the first unit 16 and the vibrators 82 located in the second unit 18**.

The machine is completely automated once it is initially set up and is capable of controlling automatically the grade, slope and steering. This is accomplished with the use of a steering grade and slope sensor system which employed in U.S. Pat. No. 3,779,661 to Godbersen.

Figure 9:
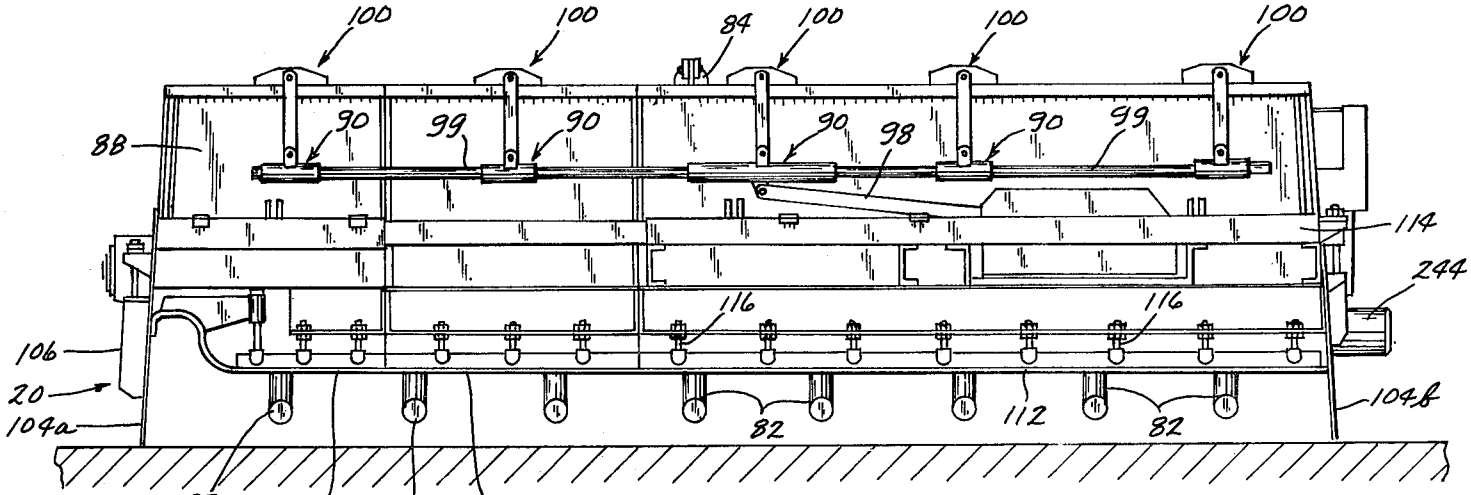
FIG. 9 is a rear view of the first receiving unit and the slip form assembly taken along line 9—9 of FIG. 4.
Figure 10:
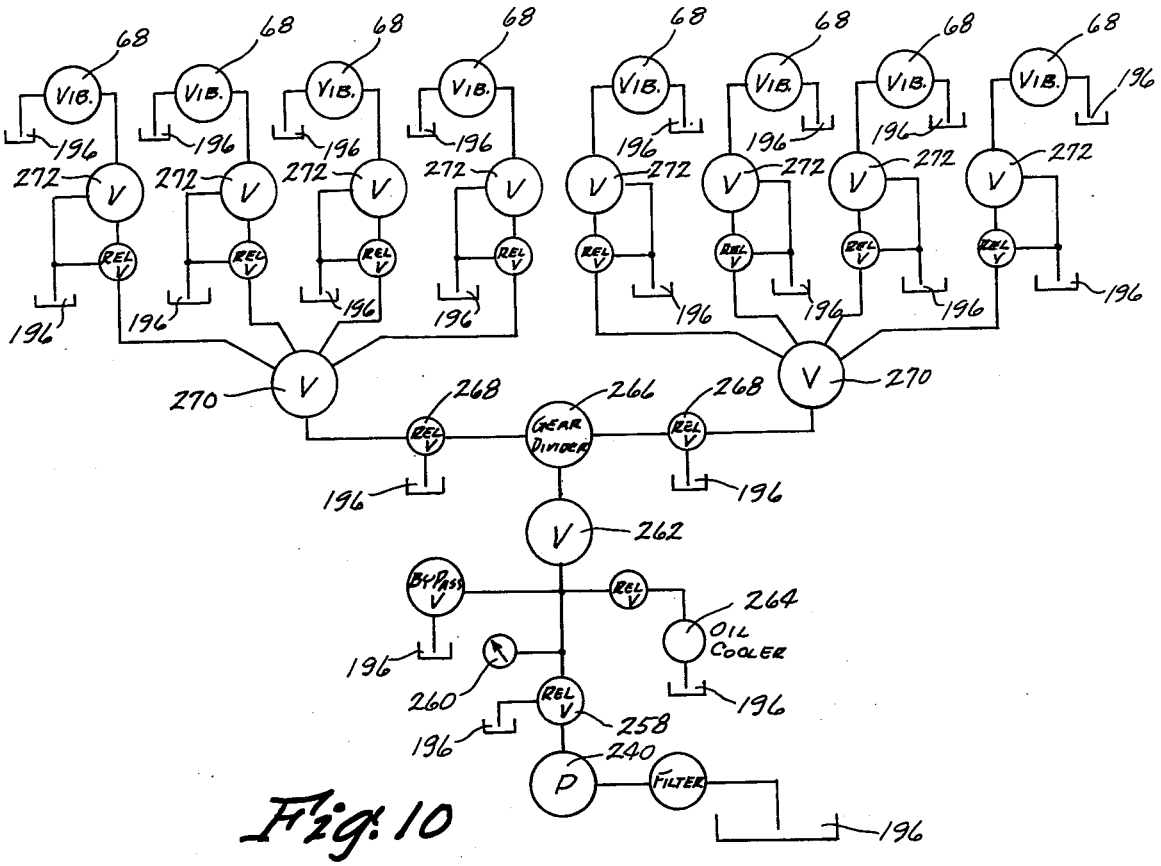
FIG. 10 is a diagram showing the hydraulic control system for the vibrator assembly positioned in the first receiving unit.
Figure 10A:
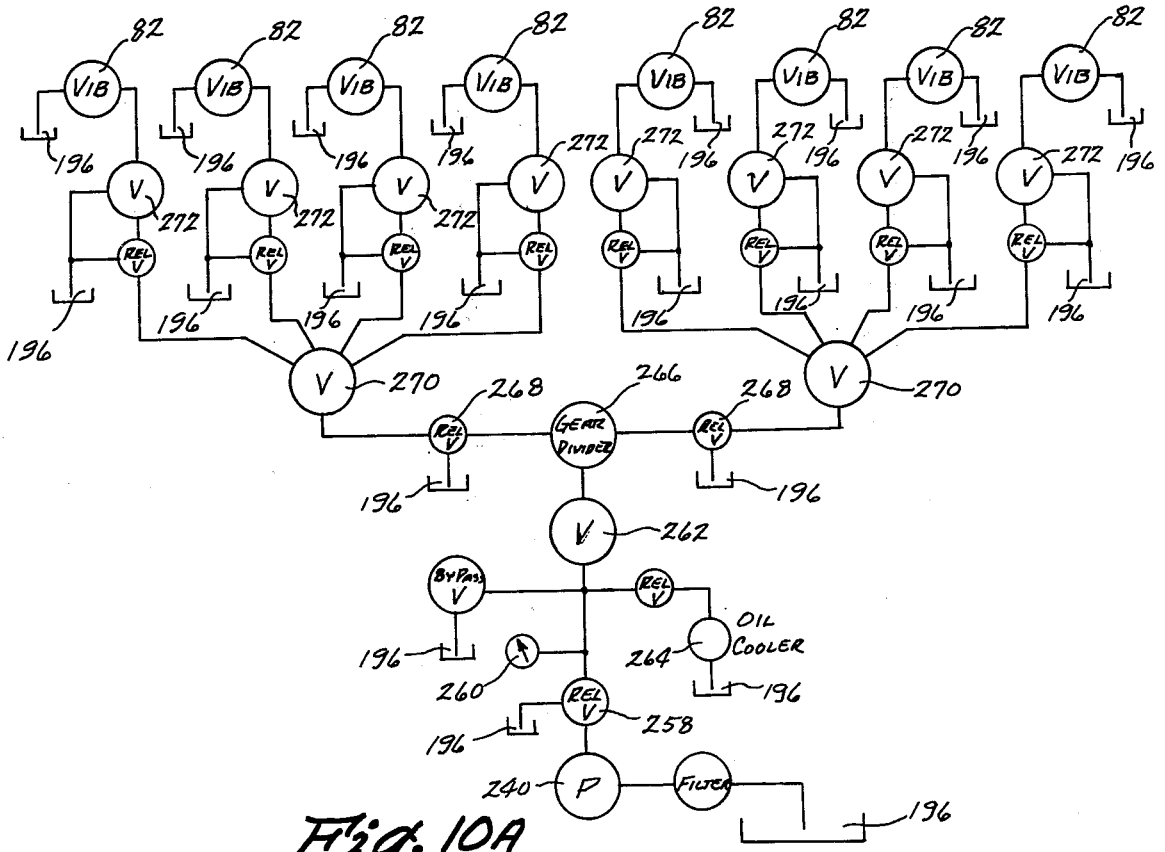
FIG. 10*a* is a diagram showing the hydraulic control system for the vibrator assembly positioned in the second receiving unit.
Figure 11:
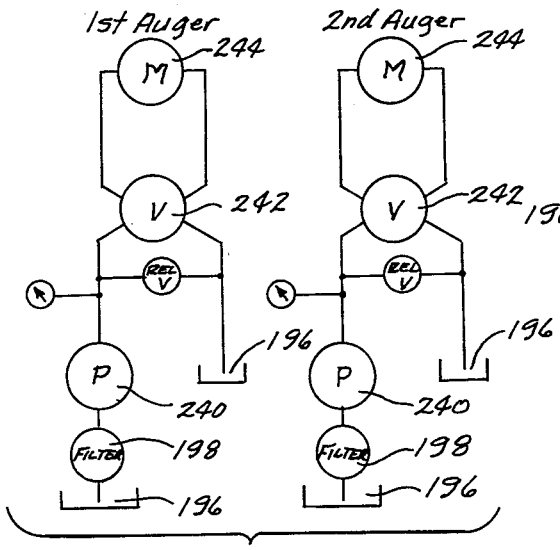
FIG. 11 is a diagram showing the hydraulic control system for the first and second auger assemblies.
Figure 12:
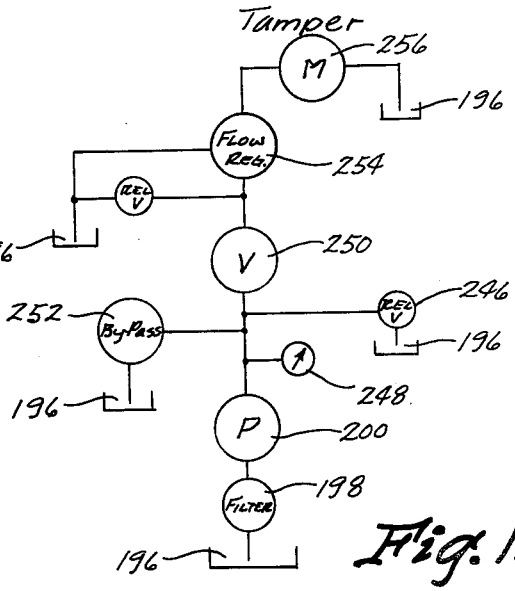
FIG. 12 is a diagram showing the hydraulic control system for a tamping bar assembly.
Figure 13:
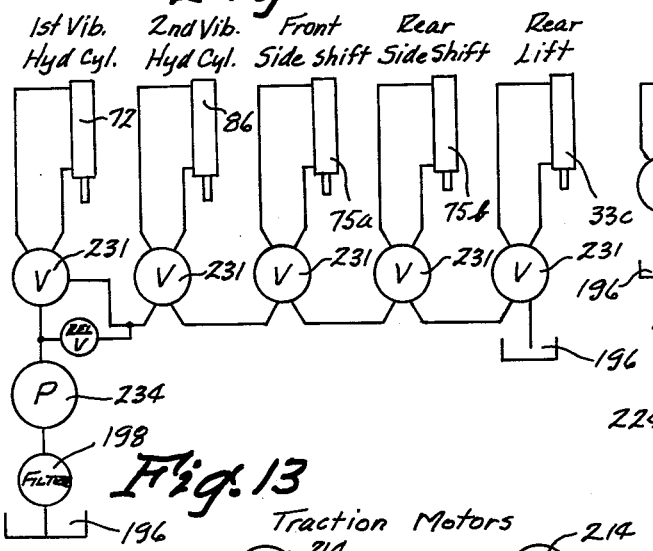
FIG. 13 is a diagram showing the hydraulic control system for the adjustable device on the rear bolster, the front and rear side shift devices and the first and second vibrator lifting devices.
Figure 14:
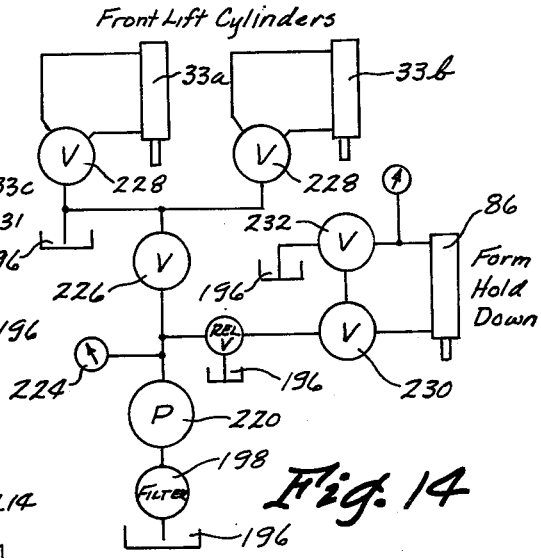
FIG. 14 is a diagram showing the hydraulic control system for the front lift adjustable devices and a slip form hold down device.

The cycle of operation of the machine 10 is shown in FIG. 9 wherein a first cementitious composition is placed in the first unit 16. By motion of the augers 66, the first cementitious composition is spread out evenly in front of the first unit. The first strike-off element 74 is set at the level desired and therefore determines the height of the bottom layer of the first cementitious composition as the machine moves forward. Simultaneously the second cementitious composition is placed in the second unit 18. The vibrators 82 of the second unit 18 serve an identical function as the vibrators 72 of the first unit. The second strike-off 88, in cooperation with the tamping bar 90 then levels the top layer of the second cementitious material. As the machine moves forward, the slip form including the top and rear portions 110 and 112 provide the finishing of the top surface of the second cementitious composition. It should be noted that other methods of finishing the top surface of the second composition may be employed in place of the conventional slip form method disclosed herein.

The operation of the present invention can best be described by reference to FIG. 6. It can be seen in FIG. 6 that a first composition 11 is deposited on to a base surface 13 in front of the machine 10 while the machine 10 is moving in a forward position. At the same time, a second composition 15 is being deposited into the second receiving unit 18. As the machine 10 moves in a forward direction, the vibrators 72 pass through the first composition 11 and tend to remove any air pockets which are present. At the same time, the auger 66 is rotating so as to roughly level off the top surface of the first composition 11 and keep the excess material on the top moving across and forwardly. Directly behind the auger 66 in the first receiving unit 16 is disposed the first strike-off element 74 as was described above. This first strike-off element 74 removes the remainder of the excess material 11 and this element 74 determines the top level of the first composition 11.

As the first receiving unit 16 and its associated structure is operating to form the first composition at the desired level, similar structure is in operation in the second receiving unit for forming and shaping the second composition 15. Vibrator elements 84 are disposed in the second composition 15 for removing any air pockets therein and tending to settle this material. At the same time, the auger 80 is rotating to provide a rough leveling off of the second composition 15. Additionally, a tamping bar 90 is operating in the second receiving unit and is reciprocating in a vertical fashion to aid in the shaping and forming of the top surface of the second and top composition 15. A second strike-off means is disposed behind the tamping bar 90 and is connected to the finishing apparatus 20. This second strike-off element 88 determines the top level of the second layer of the second composition 15 as can clearly be seen in FIG. 6. Following up the strike-off element 88 is the finishing structure 20 which tends to provide whatever surface is desired for the top and final layer of material being deposited and shaped. It is noted that other methods of finishing the top surface can obviously be used in this invention.

Obviously, many modifications and variations of the present invention are possible in light of the above teachings. For example, more than two courses of pavement compositions could be formed and shaped simultaneously according to the present invention. It is therefore to be understood that, within the scope of the appended claims, the invention may be practiced otherwise than as specifically described.

We claim:

1. A method of concurrently laying a multiple layered pavement on a base surface by use of a single machine having a normal direction of movement, said machine comprising:

a movable frame;

a first means attached to a front portion of said frame for receiving a first composition;

a first strike-off means attached to said frame behind said first receiving means and being positioned generally transversely of the normal direction of movement of said frame for determining a top level of said first composition;

a second means attached to said frame for receiving said second composition and depositing said second composition on top of said first composition; and a second strike-off means attached to said frame behind said second receiving means and being positioned generally transversely to the normal direction of movement of said frame for determining a top level of said second composition; said method comprising:

depositing a first homogeneous cementitious composition in a plastic condition on said base surface in front of said first means for receiving said first composition;

leveling said first composition with said first strike-off means;

depositing a second homogeneous cementitious composition in a plastic condition into said second means for receiving the second composition;

leveling said second composition by use of said second strike-off means; and whereby all of the steps of said method are performed simultaneously.

2. The method of claim 1 whereby said first composition is formed of different material than the second composition.

3. The method of claim 1 including the step of slipforming the first and second compositions to a predetermined shape.

* * * * *